US009038591B2

(12) United States Patent
Dudek

(10) Patent No.: US 9,038,591 B2
(45) Date of Patent: May 26, 2015

(54) INTAKE AIR CONTROL SYSTEM FOR MULTI-CYLINDER COMBUSTION ENGINE

(71) Applicant: Kenneth D Dudek, Howell, MI (US)

(72) Inventor: Kenneth D Dudek, Howell, MI (US)

(73) Assignee: FCA US LLC, Auburn Hills, MI (US)

( * ) Notice: Subject to any disclaimer, the term of this patent is extended or adjusted under 35 U.S.C. 154(b) by 150 days.

(21) Appl. No.: 13/648,604

(22) Filed: Oct. 10, 2012

(65) Prior Publication Data

US 2014/0096734 A1 Apr. 10, 2014

(51) Int. Cl.

| | |
|---|---|
| ***F02M 35/10*** | (2006.01) |
| ***F01L 3/00*** | (2006.01) |
| ***F02D 9/10*** | (2006.01) |
| *F01L 3/08* | (2006.01) |
| *F01L 3/06* | (2006.01) |
| *F02M 35/116* | (2006.01) |

(52) U.S. Cl.

CPC ..... *F02M 35/10255* (2013.01); *F01L 3/08* (2013.01); *F02M 35/10301* (2013.01); *F02M 35/10* (2013.01); *F01L 3/06* (2013.01); *F02D 9/10* (2013.01); *F02D 9/1095* (2013.01); *F02M 35/10354* (2013.01); *F02M 35/116* (2013.01)

(58) Field of Classification Search

CPC ..... F02D 9/10; F02D 9/1095; F02D 11/10; F02M 35/10; F02M 35/10255; F02M 35/10321; F02M 35/10144; F02M 35/112; F02M 35/10118; F02M 35/10301; F01L 3/08; F01L 3/06; F01L 2101/00; F02B 2275/22; F02B 27/02

USPC ..... 123/336, 184.53, 188.16, 188.7, 123/184.21, 184.31, 184.56

See application file for complete search history.

(56) References Cited

U.S. PATENT DOCUMENTS

| | | | |
|---|---|---|---|
| 2,315,775 | A | 4/1943 | D'Arcey |
| 2,883,144 | A | 4/1959 | Kendig |
| 3,264,949 | A | 8/1966 | Dieten |
| 3,319,925 | A | 5/1967 | Kojima et al. |
| 4,210,107 | A | 7/1980 | Shaffer |
| 4,274,368 | A | 6/1981 | Shaffer |
| 4,336,776 | A | 6/1982 | Sumiyoshi et al. |
| 4,504,038 | A | 3/1985 | King |

(Continued)

FOREIGN PATENT DOCUMENTS

| | | | |
|---|---|---|---|
| FR | 2877044 | A1 | 4/2006 |
| WO | 03/095815 | A1 | 11/2003 |

OTHER PUBLICATIONS

International Search Report and Written Opinion for International Application No. PCT/US2013/061312, International Filing Date Sep. 24, 2013.

*Primary Examiner* — Lindsay Low
*Assistant Examiner* — Syed O Hasan
(74) *Attorney, Agent, or Firm* — Ralph E Smith

(57) ABSTRACT

An intake control system for a multi-cylinder combustion engine with control valves positioned within intake passageways that can vary the cross-sectional area of the intake runners to increase air intake velocity at low engine speeds. The control system includes an inner frame that can be inserted into a lower manifold after manufacture. The inner frame includes a plurality of flapper valves that are actuated by a four-bar link design, which is driven by a hypoid gear-set. The control system controls an internal DC electric motor that actuates a worm-drive gear-set, which in turn drives the hypoid gear-set to either engage or retract the flapper valves within the intake passageways.

21 Claims, 9 Drawing Sheets

(56) References Cited

U.S. PATENT DOCUMENTS

| | | | | |
|---|---|---|---|---|
| 4,651,969 | A | 3/1987 | Dowdall | |
| 4,805,573 | A | 2/1989 | Macfarlane et al. | |
| 4,977,866 | A | 12/1990 | Wilkins | |
| 5,010,862 | A | 4/1991 | Hashimoto et al. | |
| 5,103,867 | A | 4/1992 | Wu | |
| 5,211,139 | A | 5/1993 | Houle et al. | |
| 5,255,649 | A | 10/1993 | Isaka | |
| 5,596,966 | A | 1/1997 | Elder | |
| 5,671,712 | A | 9/1997 | Uchida | |
| 5,711,261 | A * | 1/1998 | Gambardella | 123/184.35 |
| 5,803,045 | A | 9/1998 | Adamisin et al. | |
| 5,979,401 | A | 11/1999 | Hickey | |
| 6,039,029 | A | 3/2000 | Nagasaka et al. | |
| 6,244,228 | B1 | 6/2001 | Kuhn et al. | |
| 6,793,194 | B1 | 9/2004 | Grinberg | |
| 7,231,898 | B2 * | 6/2007 | Letourneau et al. | 123/184.21 |
| 7,302,930 | B1 | 12/2007 | Dudek | |
| 7,448,357 | B2 * | 11/2008 | Dudek | 123/336 |
| 7,814,876 | B2 * | 10/2010 | Nakawatase | 123/184.21 |
| 8,555,847 | B2 * | 10/2013 | Menin et al. | 123/184.61 |
| 2010/0186705 | A1 * | 7/2010 | Vichinsky et al. | 123/184.55 |

* cited by examiner

INTAKE AIR CONTROL SYSTEM FOR MULTI-CYLINDER COMBUSTION ENGINE

FIELD

The present disclosure relates to a control system for the intake manifold of a multi-cylinder combustion engine and, more particularly, to a system for controlling a charge motion control valve ("CMCV") to increase the velocity of the air-fuel mixture.

BACKGROUND

Conventional intake manifold systems of internal combustion engines for passenger cars and commercial vehicles are generally designed for maximum efficiency at high or high medium engine speeds. Such manifolds typically have fixed cross-sectional areas with no provision for adjusting the velocity of the air-fuel mixture flow at low-medium or low speeds. With a fixed cross-section, the velocity of the air-fuel mixture decreases at low engine speeds or low revolutions-per-minutes ("RPMs"). As a result, these engines are noticeably inefficient in terms of power and fuel consumption when the engine is operating at low RPMs.

Certain prior art intake manifold systems have been designed to increase the air velocity by decreasing the cross-sectional of the intake runners at low RPMs. For example, recent developments in intake manifolds have implemented a flat valve plate positioned within the intake runner that is attached to one side of the intake runner by a single pivot. At low RPMs, the valve plate is actuated to rotate about the single pivot to decrease the cross-sectional area of the intake runner.

The object of such prior art designs is to increase the velocity of the air-fuel mixture during periods of low RPMs (i.e., low engine speeds) to ensure smoother and more efficient operation of the engine in terms of power and efficiency. However, such systems also have many drawbacks including the significant torque applied to the single pivot during engine operation, which compromises the structure and operation of the manifold system. Moreover, such systems have a design flaw in which the tip of the valve plate does not extend closer to the combustion chamber when the valve plate is in the extended (i.e., the smaller cross-section) position, reducing the effectiveness of increasing air fuel velocity in the combustion chamber. Such design requires a larger mounting flange at the head intake port surface to accommodate the mounting surface seal and have the valve plate tip near the combustion chamber. Accordingly, there is a need for improvement in the art.

SUMMARY

In one form, the present disclosure provides an intake control system for controlling a CMCV to increase the velocity of the air-fuel mixture. More particularly, the system provides a lower intake manifold with variable area intake runners. The system includes a plurality of control valves, i.e., flapper valves, that are actuated to reduce the cross-sectional area of the intake runners. By doing so, the control system takes advantage of the higher charge inertia developed in low cross-sectional area passages at low engine speeds and gas flow conditions, while also providing for increases in cross-sectional area for high performance at high engine speeds and load conditions where charge flow rates are sufficiently high. The manufacturer can define the control system to engage or retract the flapper valves based on varying driving condition variables including engine speed, engine load, and the like.

In the exemplary embodiment, the lower intake manifold includes an inner frame assembly that can be inserted into the lower manifold after partial assembly (i.e., assembly and testing of the inner frame assembly) producing greater manufacturing control. The inner frame assembly includes the flapper valves that are actuated by a four-bar link design. Each flapper valve is coupled to a drive link that is driven by a hypoid gear-set. The hypoid gear-set is in turn driven by a worm drive gear-set that is powered by a DC electric motor. The control system controls the DC electric motor to actuate the system to either engage or retract the flapper valves based on predefined and/or variable conditions set by the manufacturer.

Further areas of applicability of the present disclosure will become apparent from the detailed description and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

Figure 1A:
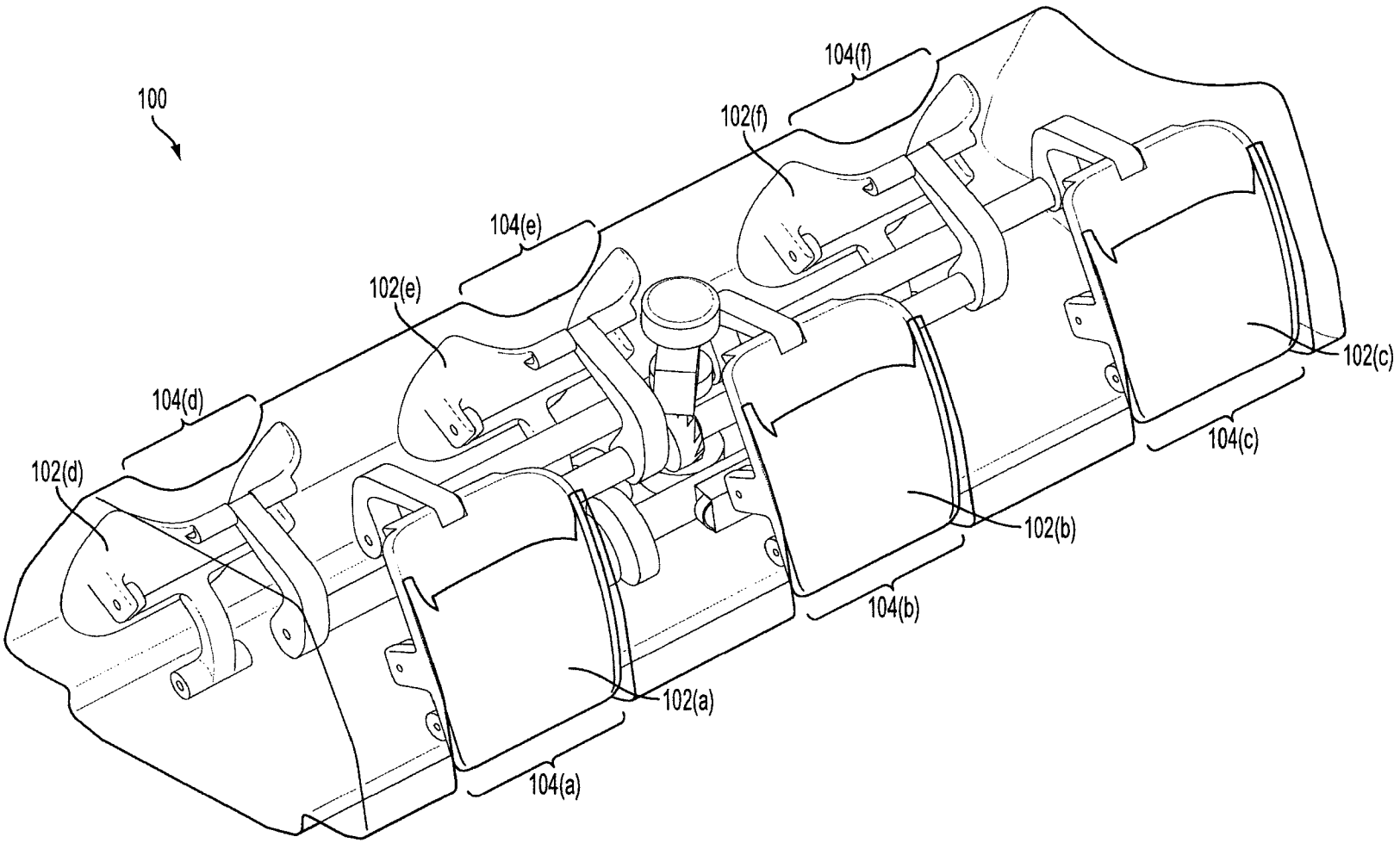
FIGS. 1A and 1B are perspective views of the inner frame assembly of the intake manifold in accordance with an exemplary embodiment.

FIG. 1A illustrates a perspective view of the inner frame assembly 100 of the intake manifold in accordance with an exemplary embodiment. In particular, the inner frame assembly 100 includes a main body molded from a plastic, a metal, or the like, that includes six flapper valves 102(*a*)-102(*f*) that are positioned within six intake air runners 104(*a*)-104(*f*), respectively. It is noted that the structure of the intake air runners 104(*a*)-104(*f*) is defined partially by the inner frame assembly 100 (as curved or substantially regular-shaped indentations/recessions in the main body—see, e.g., intake runners 104(*a*) and 104(*b*) in FIGS. 6A and 6B) and completed when the inner frame assembly 100 is installed into the lower manifold 200, as will be described in more detail below. Also, it should be appreciated that while inner frame assembly 100 is provided as an exemplary embodiment for a V6 engine, it is contemplated that the design described herein can be employed for any applicable V-type combustion engine (e.g., V8 engine) or other multi-cylinder combustion engine such as a multi-cylinder inline engine, a W-type engine or the like. Moreover, the number of flapper valves in the inner frame assembly preferably corresponds to the number of intake runners. For example, a V8 engine would have an inner frame assembly with a main body having eight flapper valves in the exemplary embodiment. Provided herein is an intake manifold system with an improved mechanism for reducing the cross-sectional area of the intake runners at low engine speeds.

Figure 3:
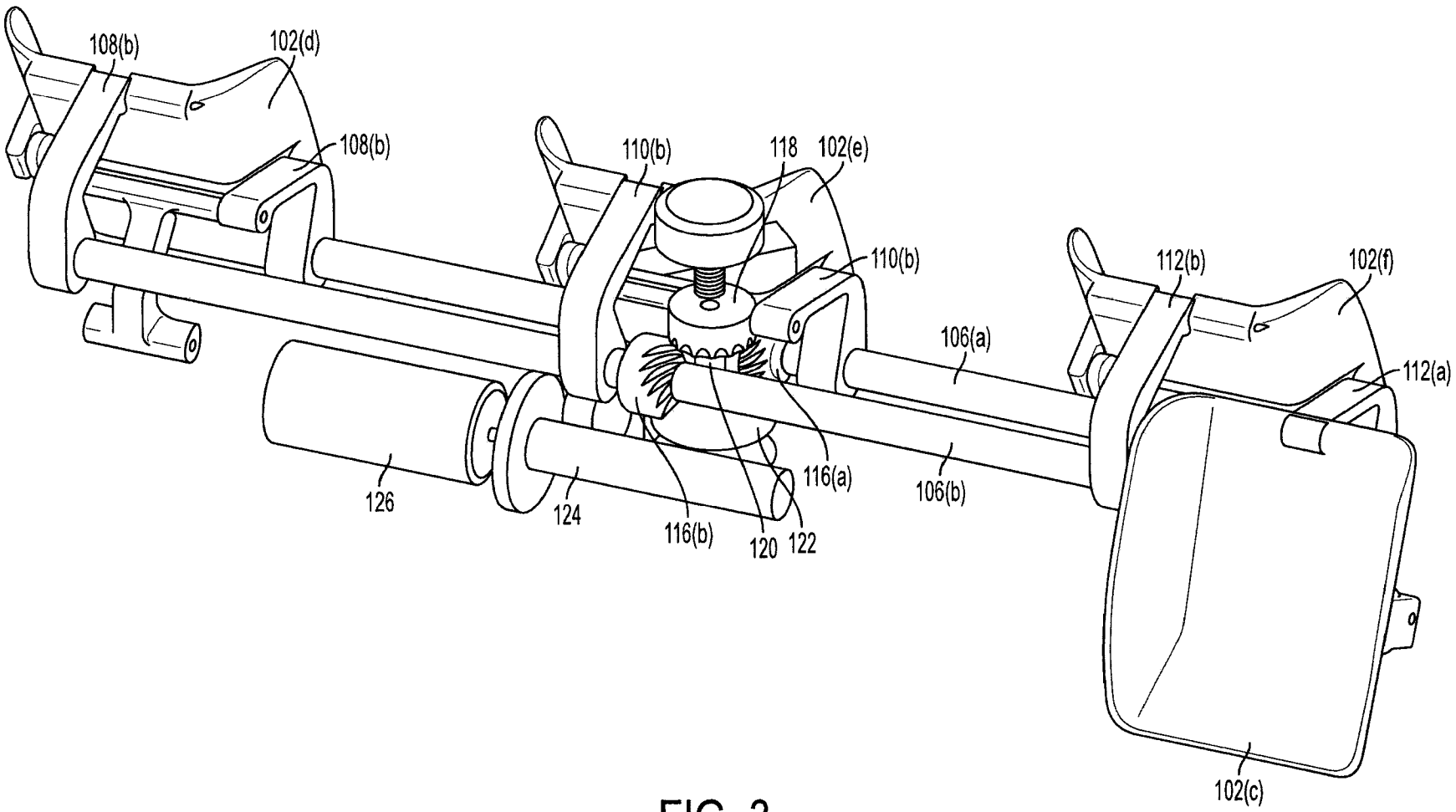
FIG. 3 is a perspective view of the internal actuating components of the inner frame assembly in accordance with an exemplary embodiment.
Figure 4:
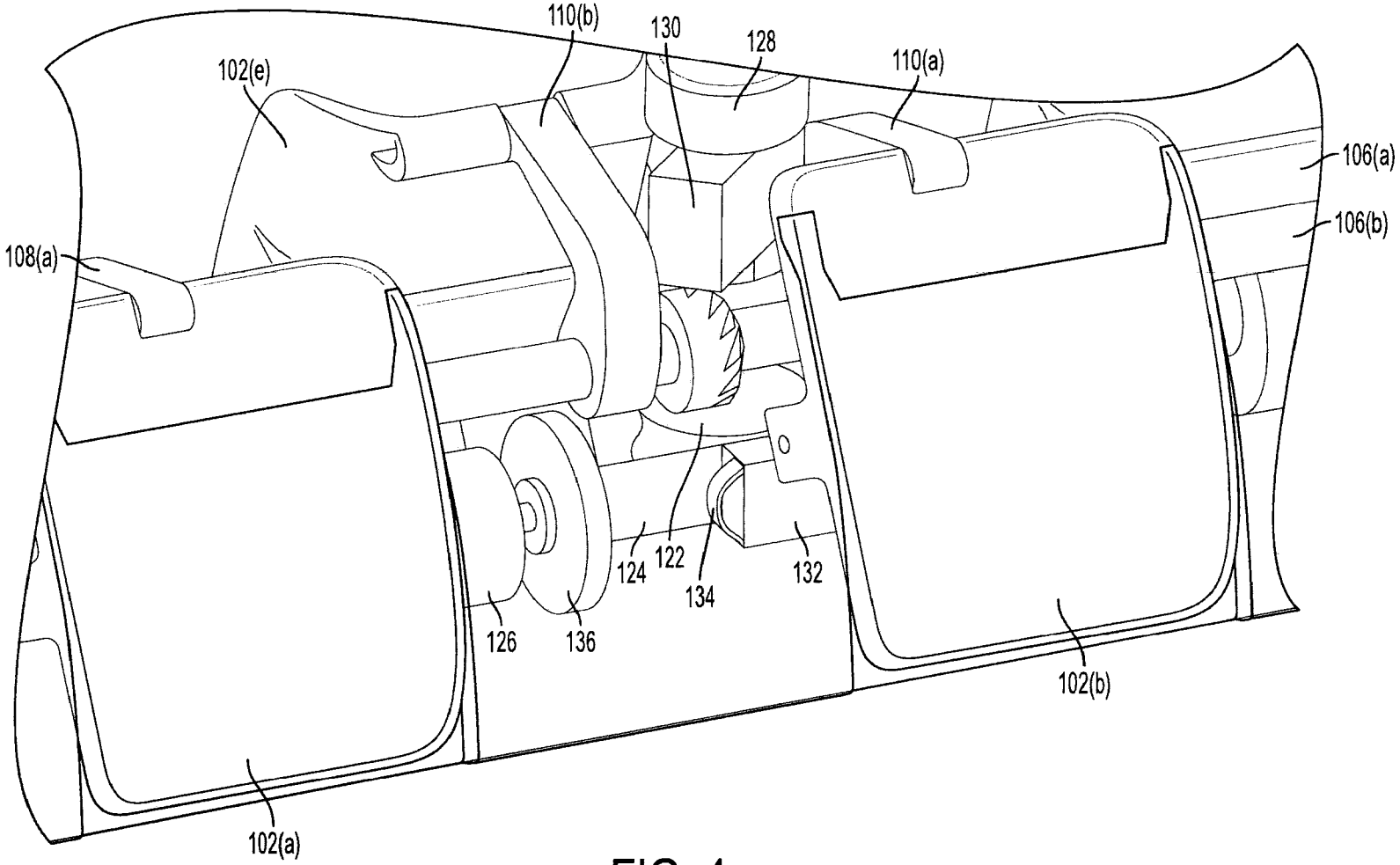
FIG. 4 is an enlarged, perspective view of the internal actuating components of the inner frame assembly in accordance with an exemplary embodiment.

As shown, the six flapper valves 102(*a*)-102(*f*) illustrated in FIG. 1A are in a retracted position resulting in substantially consistent cross-sections of the intake runners. Driven by a hypoid gear-set that is shown in FIGS. 3 and 4 and described below, the flapper valves 102(*a*)-102(*f*) can be actuated to reduce the cross-sectional area of the intake air runners 104(*a*)-104(*f*) to effectively increase air velocity as the air enters the combustion chambers of the engine during intake. This effect is particularly useful when the engine is operating at lower RPMs and the intake air velocity is lower. As will be described in more detail below, the increased air velocity creates additional tumble and swirl to the charge motion within the combustion chamber. Furthermore, it is noted that although the exemplary embodiment described herein employs specific gear sets, including a hypoid gear set and a worm-drive gear-set, to actuate the flapper valves, it is contemplated that a variety of drive mechanisms can be used to actuate the flapper valves of the CMCV manifold depending on factors including function, packaging, costs, required accuracy, manufacturability, and other market factors. Such drive mechanisms include direct drive with electric motor, direct drive with vacuum actuator, only spur gear sets, only worm-drive gear-set, rack and pinion drives, lever-arm mechanisms, screw thread and nuts, helical gear sets, cam type mechanisms, and vacuum or electric motor actuation for all mechanical mechanisms. It should be appreciated to one skilled in the art based on the disclosure herein that such mechanisms can be implemented within the inner frame 100 to drive the four-bar link design and effectively actuate the six flapper valves 102(*a*)-102(*f*) according to design requirements based on the particular engine configuration and/or factors mentioned above.

Figure 1B:
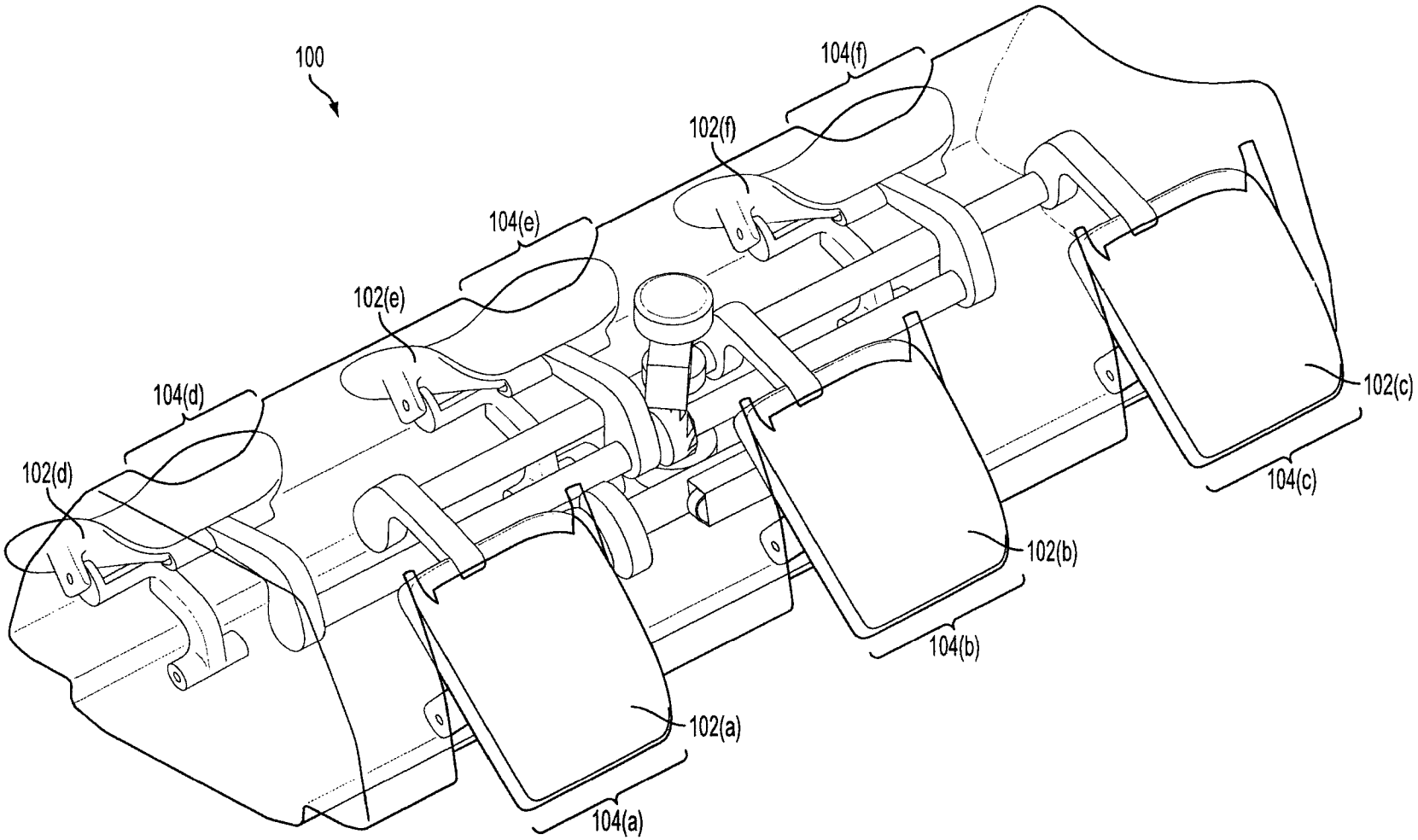

FIG. 1B illustrates the inner frame assembly 100 with the six flapper valves 102(*a*)-102(*f*) in an extended or engaged position. As will be described in detail below, each of the flapper valves 102(*a*)-102(*f*) is constructed as part of a four-bar link mechanism in which the drive link or upper link is rotated about its pivot by the hypoid gear-set. Specifically, in operation the hypoid gear-set rotates causing each flapper valve to extend into the passageways of the respective intake runners, effectively reducing the cross-sectional area. As will be shown in FIGS. 6A and 6B, by using a four-bar link design, the flapper valves extend outwardly and downwardly into the intake runner. As a result, the tip of the flapper valve is preferably positioned upstream of a seal groove, for example, an O-ring seal groove (discussed below with respect to reference numbers 240(*a*) and 240(*b*)) at the head mounting surface when in the retracted position, but also positioned close to the tip of the fuel injector when it is in the engaged position. Moreover, by using the four-bar link design as opposed to a single pivot, the flapper valves create a lower approach angle for the air velocity when it is flowing into the intake runner, creating a more efficient nozzle at the injector tip with a higher air velocity at the injector tip. Preferably, the approach angle is 25° or lower, although the exemplary embodiment should in no way be limited to this angle and as discussed below, the engine designer can adjust the lengths of the links to the flapper valves to adjust the movement and positioning of the flapper valves within the intake runners.

Figure 2:
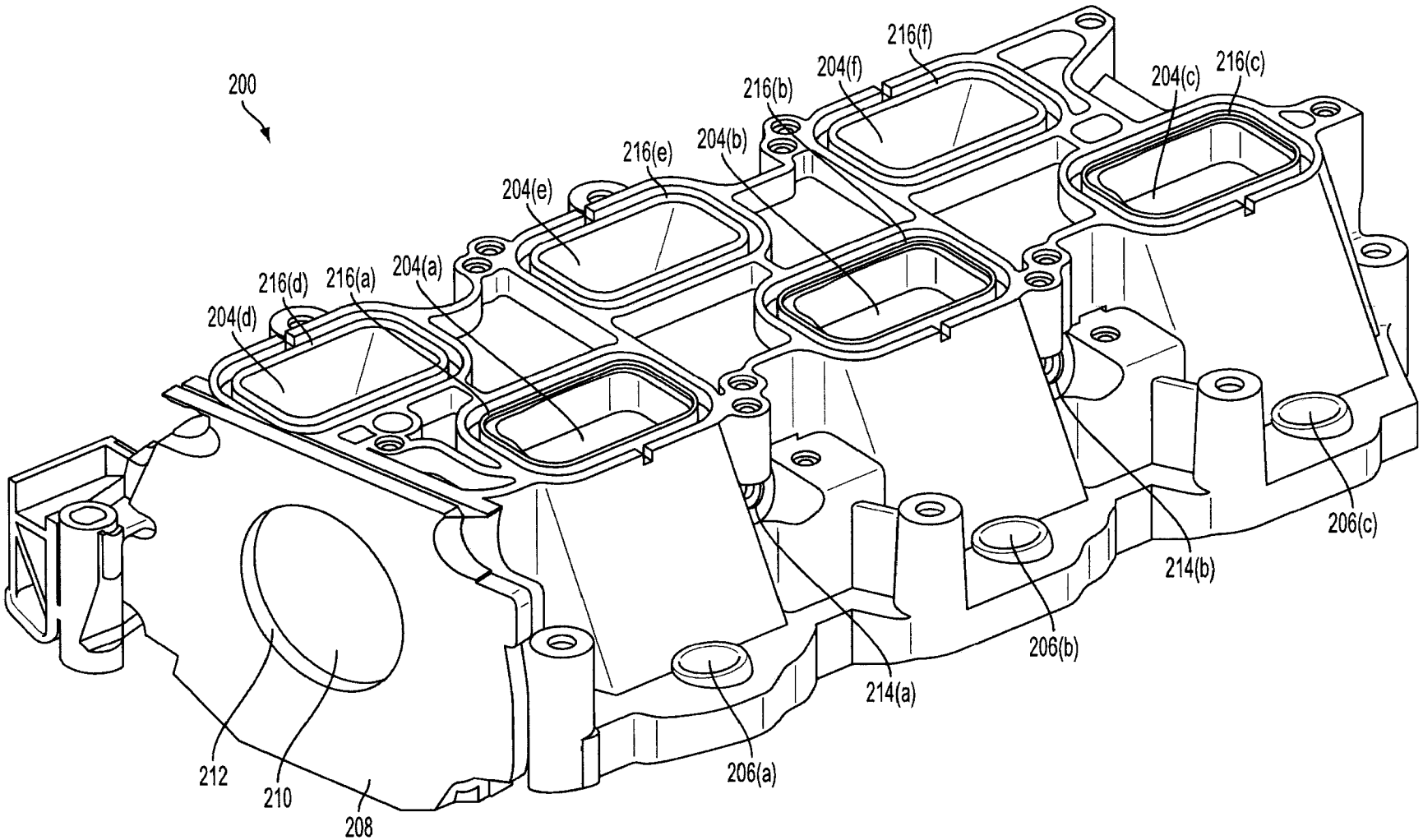
FIG. 2 is a perspective view of the lower manifold in accordance with an exemplary embodiment.

FIG. 2 illustrates the lower manifold 200 in accordance with an exemplary embodiment. It is contemplated that inner frame assembly 100 can be manufactured and assembled separately from lower manifold 200 and subsequently inserted within lower manifold 200. Upon insertion, inner frame assembly 100 can be sealed to the lower manifold 200 using any appropriate welding process such as friction welding or the like.

As shown, lower manifold 200 includes six intake ports 204(*a*)-204(*f*) that correspond to the intake runners 104(*a*)-104(*f*) of inner frame assembly 100 discussed above with respect to FIGS. 1A and 1B. Each intake port is positioned in the lower manifold 200 to align substantially or completely with each correspond intake runner once inner frame assembly 100 is inserted and sealed. As noted above, the intake runners are fully defined once the inner frame assembly 100 is installed into the lower manifold 200. As should be appreciated to one skilled in the art, air enters intake ports 204(*a*)-204(*f*) during engine operation and travels downward through intake runners 104(*a*)-104(*f*) before exiting into respective intake ports in the heads and then to combustion chambers. Moreover, six seal grooves, such as O-ring grooves, 216(*a*)-216(*f*) are provided around each of the six intake ports 204(*a*)-204(*f*), respectively. Advantageously, these seals are continuous so as to prevent air leakage during engine operation. In the exemplary embodiment, the grooves are shown as O-ring grooves, but the disclosure should in now way be so limited.

The lower manifold 200 also comprises six ducts (e.g., three shown as 206(*a*)-206(*c*)) that are provided for fuel injectors for each of the combustion chambers of the engine and are positioned adjacent to each of the intake runners 104(*a*)-104(*f*), respectively. The lower manifold 200 further includes cover 208 that is affixed to the lower manifold 200 and to the inner frame assembly 100, which seals the two components together. Preferably, cover 208 includes an aperture 212 (not necessarily shown to scale) that is provided for power cables to connect an internal DC electric motor (discussed below) to an external power source, such as the electronic system of the vehicle. As further shown, an outer surface 210 of the inner frame assembly 100 is illustrated in FIG. 2 after the inner frame assembly has been inserted into of the lower manifold 200. It should further be appreciated that the lower manifold 200 includes additional holes that are provided to secure it, via bolts or the like, to the inner frame assembly 100 after it is inserted. For example, apertures 214(*a*) and 214(*b*) are provided such that bolts can be inserted to secure and seal the lower manifold 200 to inner frame assembly 100. By manufacturing inner frame assembly 100 as a separate mechanism from the lower manifold 200, the manufacturer is able to assemble and test the inner frame assembly, including the multiple gear-sets and flapper valves, before final installation.

FIG. 3 illustrates a perspective view of the internal actuating components of inner frame assembly 100 in accordance with an exemplary embodiment. For illustrative purposes, FIG. 3 illustrates only four of the six flapper valves 102(*c*)-102(*f*). Flapper valves 102(*a*) and 102(*b*) are not shown in FIG. 3 so as to more clearly illustrate the internal actuating components. As shown, inner frame assembly 100 generally comprises two actuating members 106(*a*) and 106(*b*) that each include horizontal shafts each coupled to three arms 108(*a*), 110(*a*), 112(*a*) and 108(*b*), 110(*b*), 112(*b*), respectively, that, preferably, are evenly positioned from one another. These arms serve as the drive links (i.e., upper links) for the four-bar link mechanism and are coupled to respective flapper valves. For example, as shown in FIG. 3, drive link 112(*a*) is coupled to flapper valve 102(*c*), drive link 108(*b*) is coupled to flapper valve 102(*d*), drive link 110(*b*) is coupled to flapper valve 102(*e*), and drive link 112(*b*) is coupled to valve/flapper 102(*f*). Moreover, each drive link is coupled to its respective flapper by any mechanical pin, as would be understood to one of ordinary skill in the art, to create a pivot such that the drive link can rotate about its pivot with respect to the flapper valve. In the exemplary embodiment, it is contemplated that each of the actuating members 106(*a*) and 106(*b*) and its respective set of three drive links is manufactured as a single component using any suitable material such as aluminum, plastic, magnesium or the like. As a result, tolerance accumulation issues are reduced during operation and over time, which also effectively allows for larger manufacturing tolerances and less costs on individual pieces. However, it is also noted that in an alternative embodiment, the actuating members 106(*a*) and 106(*b*) may be manufactured separately and the respective sets of drive links can be subsequently affixed to the actuating members 106(*a*) and 106(*b*) by any suitable techniques.

As further shown, the two actuating members 106(*a*) and 106(*b*) are driven by a hypoid gear-set. Specifically, each actuating members 106(*a*) and 106(*b*) includes a shaft and a respective driven wheel 116(*a*) and 116(*b*) (i.e., a driven wheel of the hypoid gear-set) that is coupled to the hypoid drive gear 118 (i.e., a driver wheel) of the hypoid gear-set. In the exemplary embodiment, the shafts of the two actuating members 106(*a*) and 106(*b*) are preferably positioned at a 90° angle from the shaft of the hypoid gear-set. More particularly, the hypoid drive gear 118 includes a vertical shaft 120 that extends downward at a 90° angle from the driver gear 118 and itself is coupled to a driven wheel 122 extending in a horizontal plane from the vertical shaft 120. The hypoid drive gear 118 and each of the driven wheels 116(*a*) and 116(*b*) form a hypoid gear set and are collectively referred to herein as the hypoid gear set.

In addition, a worm-drive gear-set is provided to drive the hypoid gear-set. Specifically, the worm-drive gear-set comprises the driven wheel 122 and a worm-drive gear 124. During operation, the worm-drive gear 124 is driven by a DC electric motor 126. As would be understood by those skilled in the art, DC electric motor 126 provides power causing the worm-drive gear 124 to rotate the driven wheel 122, and, in turn, drive the hypoid gear-set actuating the flapper valves to an engaged position. Likewise, to withdraw the flapper valves to a retracted position, the DC electric motor 126 actuates the worm-drive gear 124 to rotate in the opposite direction. It is further noted that the flapper valves are not only configured to be in an engaged or retracted position. Rather, the worm-drive gear 124 can rotate to varying degrees which in turn would cause the flapper valves to actuate to a partially-engaged position (e.g., 50% engaged—50% extended into the intake runner). This result may be desired by the vehicle manufacturer if the vehicle engine is operating at a medium speed, for example. Moreover, in the exemplary embodiment, it is not necessary for the DC electric motor 126 to continuously provide power to the worm-drive gear 124 to maintain the flapper valves in an engaged position. Instead, power is only applied during the extending or retracting process, which has the effect of minimizing the load on the alternator.

FIG. 4 illustrates an enlarged perspective view of the internal actuating components of inner frame assembly 100 in accordance with an exemplary embodiment and discussed above with respect to FIG. 3. Specifically, three flapper valves 102(*a*), 102(*b*) and 102(*e*), for example, are shown as being coupled to the actuating components by respective driving links 108(*a*), 110(*a*) and 110(*b*), respectively. In turn, the drive links are respectively coupled to actuating members 106(*a*) and 106(*b*), which are driven by the hypoid gear-set as discussed above. As further shown, plug 128 is provided on top of the hypoid gear-set and a pilot block 130 is positioned between the plug and the top of the hypoid gear-set. An internal spring (see FIG. 3) within the pilot block 130 is further provided to increase downward pressure on the hypoid gear-set. This spring loaded pilot block 130 preferably results in zero backlash for the drive mechanism of the hypoid gear-set even after considerable wear during engine operation.

As further illustrated in FIG. 4, the worm-drive gear 124 extends from the DC electric motor 126 and is coupled to the driven wheel 122. A mechanical wedge 132 having a spring 134 can be positioned external to the worm-drive gear 124, effectively applying pressure inward on the worm gear-set. This spring loaded wedge preferably provides zero backlash for the drive mechanism of the worm-drive gear 124. Further, as would be understood to one skilled in the art, the combination of vertical, downward pressure being applied by the spring loaded pilot block 130 on hypoid gear-set and horizontal, inward pressure being applied to worm-drive gear driver 124 by the mechanical wedge 132 minimizes any backlash that would otherwise exist in such mechanical gear systems.

Moreover, in the exemplary embodiment, the inner frame assembly 100 is also preferably provided with a spur gear 136 positioned on the end of the worm-drive gear 124 adjacent to the DC electric motor 126. The spur gear 136 serves as a driver wheel for an encoder 142 (see FIGS. 5A and 5B) which has the driven wheel 140 of the spur gear-set and can be positioned adjacent to and driven by the spur gear 136. Advantageously, the encoder 142 is rotated by the spur gear-set to read positions of the valves for variable positioning throughout the entire operation range. In the exemplary embodiment, the gear ratio between the spur gear 136 and the driven wheel 140 of the encoder 142 is preferably 4:1 or higher to provide for an accurate yet relatively inexpensive encoder.

Figure 5A:
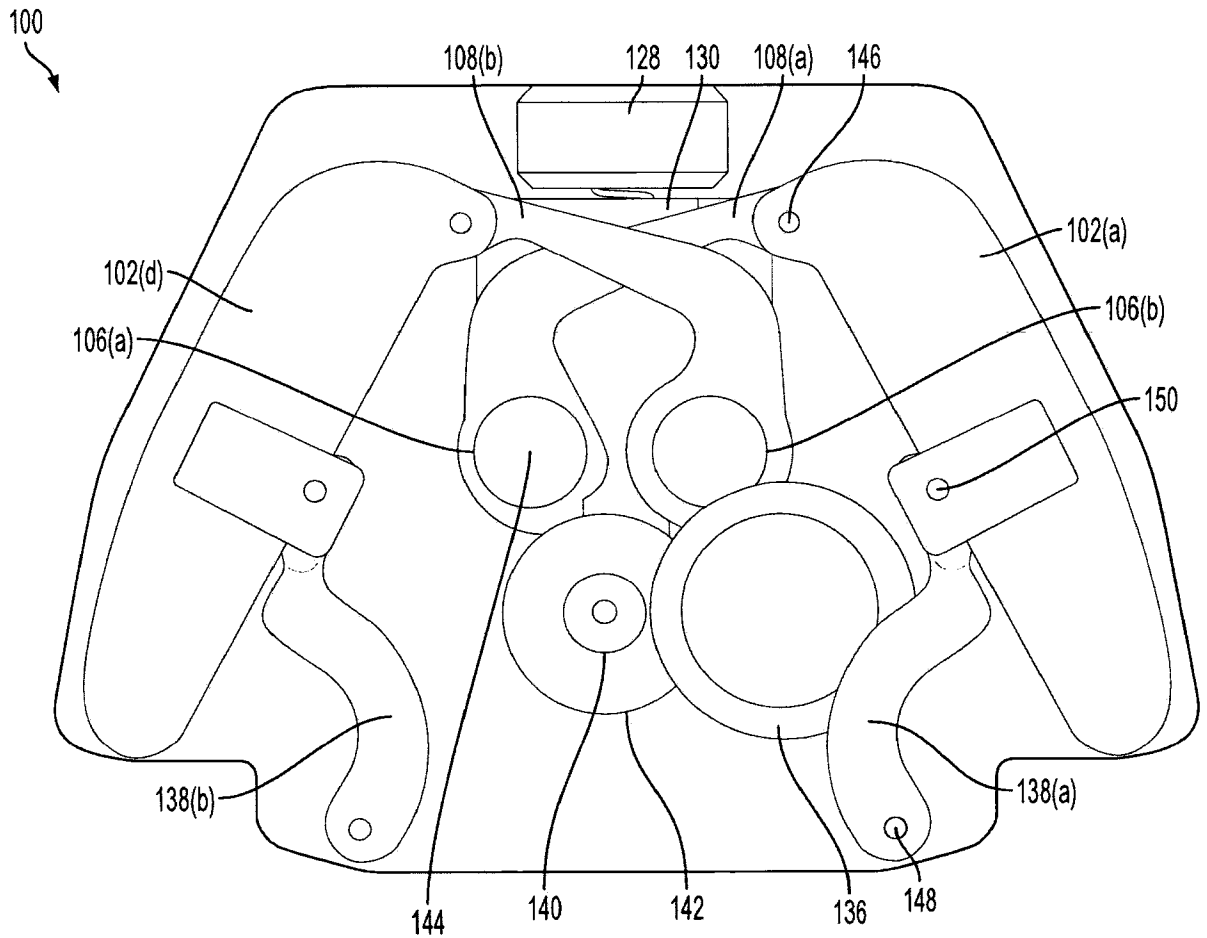
FIGS. 5A and 5B are two-dimensional, cross-sectional views of the inner frame assembly in accordance with an exemplary embodiment.
Figure 5B:
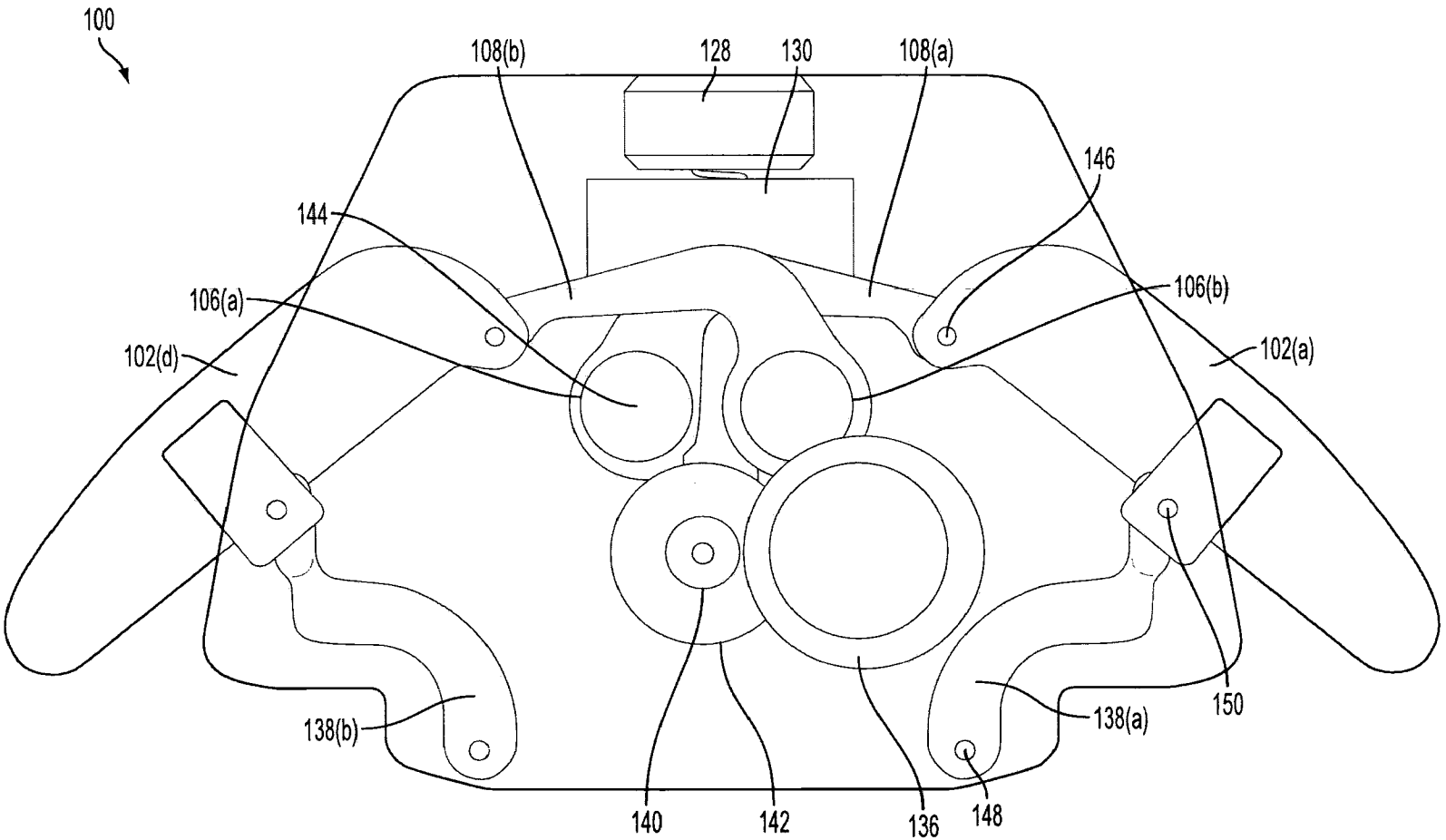

FIGS. 5A and 5B represent two-dimensional, cross-sectional views of the inner frame assembly 100 in accordance with an exemplary embodiment. As shown in FIG. 5A, the flapper valves 102(*a*) and 102(*d*) are illustrated in the retracted position. Likewise, in FIG. 5B, the flapper valves 102(*a*) and 102(*d*) are illustrated in the engaged position. It should be appreciated that while flapper valves 102(*a*) and 102(*d*) are shown in FIGS. 5A and 5B, this is for illustrative purposes as a cross-sectional view is being portrayed. Alternatively, flapper valves 102(*b*) or 102(*c*) could be provided on the right bank of inner frame assembly 100 and flapper valves 102(*e*) or 102(*f*) could be provided on the left bank of inner frame assembly 100 for this cross-sectional view.

Both FIGS. 5A and 5B illustrate plug 128, spring-loaded pilot block 130, the spur gear-set (i.e., spur gear 136 and driven wheel 140) and the encoder 142. Moreover, drive links 108(*a*) and 108(*b*) couple the respective shafts of the actuating members 106(*a*) and 106(*b*) to the flapper valves 102(*a*) and 102(*d*) and lower links 138(*a*) and 138(*b*) couple the flapper valves 102(*a*) and 102(*d*) to the inner frame assembly 100. As further shown, lower links 138(*a*) and 138(*b*) are each attached at the middle of the respective flapper valves by a pivot joint and also are attached at the lower end to the inner frame assembly 100 by a pivot joint. Further, it should be appreciated that each of the six flapper valves are all connected to the inner frame assembly using the same or similarly designed lower links.

As shown, FIG. 5B illustrates flapper valves 102(*a*) and 102(*d*) in an engaged position in which the hypoid gear-set has driven the shaft of actuating member 106(*a*) to rotate in a clockwise direction and the shaft of actuating member 106(*b*) to rotate in a counterclockwise direction. As a result, driving link 108(*a*) has forced flapper valve 102(*a*) downward causing the tip of flapper valve 102(*a*) to also extend downward and outward to the right. Likewise, driving link 108(*b*) has also forced flapper valve 102(*d*) downward causing the tip of flapper valve 102(*d*) to extend downward and outward to the left.

It should be appreciated that the four-bar link design is comprised of a first bar (i.e., the flapper valve), a second bar (i.e., the drive link), a third bar (i.e., the lower link), and a fourth bar (i.e., the inner frame assembly between the drive link and the lower link). For example, referring to flapper valve 102(*a*) in FIGS. 5A and 5B, the drive link 108(*a*) is connected to the inner frame 100 by the first actuating member 106(*a*) at a first connect point 144 and to a first pivot 146 of the flapper valve 102(*a*). It should be appreciate that the first connection point 144 is shown as the center point of the first actuating member 106(*a*). Furthermore, the lower link 138(*a*) is connected to the inner frame at a pivot 148 and at a second pivot 150 of the flapper valve 102(*a*). As discussed above, the drive link 108(*a*) drives the movement of the flapper value 102(*a*) and the pivot 146 of the flapper valve 102(*a*) enables the drive link 108(*a*) to rotate with respect to the flapper valve 102(*a*). Moreover, the second pivot 150 of the flapper valve 102(*a*) and the pivot 148 of the inner frame 100 enables the lower link 138(*a*) to rotate with respect the flapper valve 102(*a*) and to the inner frame 100, respectively. It should be understood that the same configuration, although not shown in FIGS. 5A and 5B, is used for each of the flapper valves in the exemplary system.

It is contemplated that the four-bar link mechanism enables the flapper valve 102(*a*) to move with different compound motions based on the needs of the particular engine configuration. As noted above, these different engine configurations can include inline, v-type, w-type, or the like, and can further include variations within the type of engine, i.e., intake port configuration, size and location and the like. It is also contemplated that the four pivot points 144, 146, 148 and 150 of the drive link 108(*a*) and the lower link 138(*a*), respectively, can be adjusted relative to each other and relative to the main engine axis system so that the CMCV system can be optimized for the particular engine configuration. More particularly, the lengths of the drive link 108(*a*) relative to the length of the lower link 138(*a*) can be of different lengths as designed by the engine designer to provide the effective travel motion necessary with the purpose, as stated above, of simultaneously positioning the tip of the valve flapper 102(*a*) to be closer to the opposing inner runner wall and to position the tip closer to the intake port valve seat. By adjusting the position of the four pivot points 144, 146, 148 and 150, the motion of the tip of the flapper valve 102(*a*) can vary greatly from one engine configuration to another engine configuration as necessary. In the exemplary embodiment, the motion of the flapper valve 102(*a*) upon actuation would be of a spline shape rather than a true arc or a true ellipse, but usually changing its momentary radius throughout its operating range.

Figure 6A:
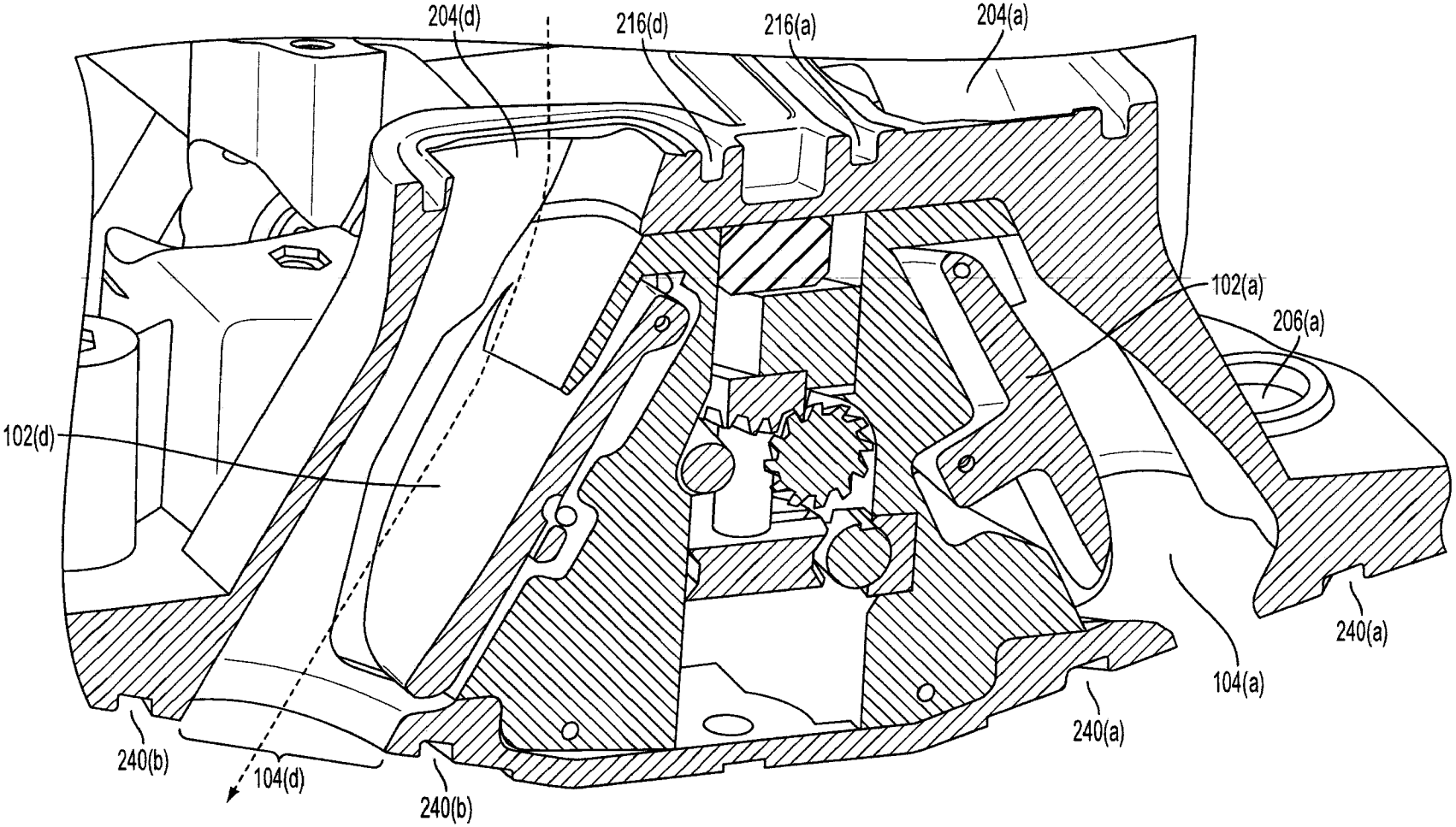
FIGS. 6A and 6B are cross-sectional perspective views of the inner frame assembly installed into the lower manifold in accordance with an exemplary embodiment.
Figure 6B:
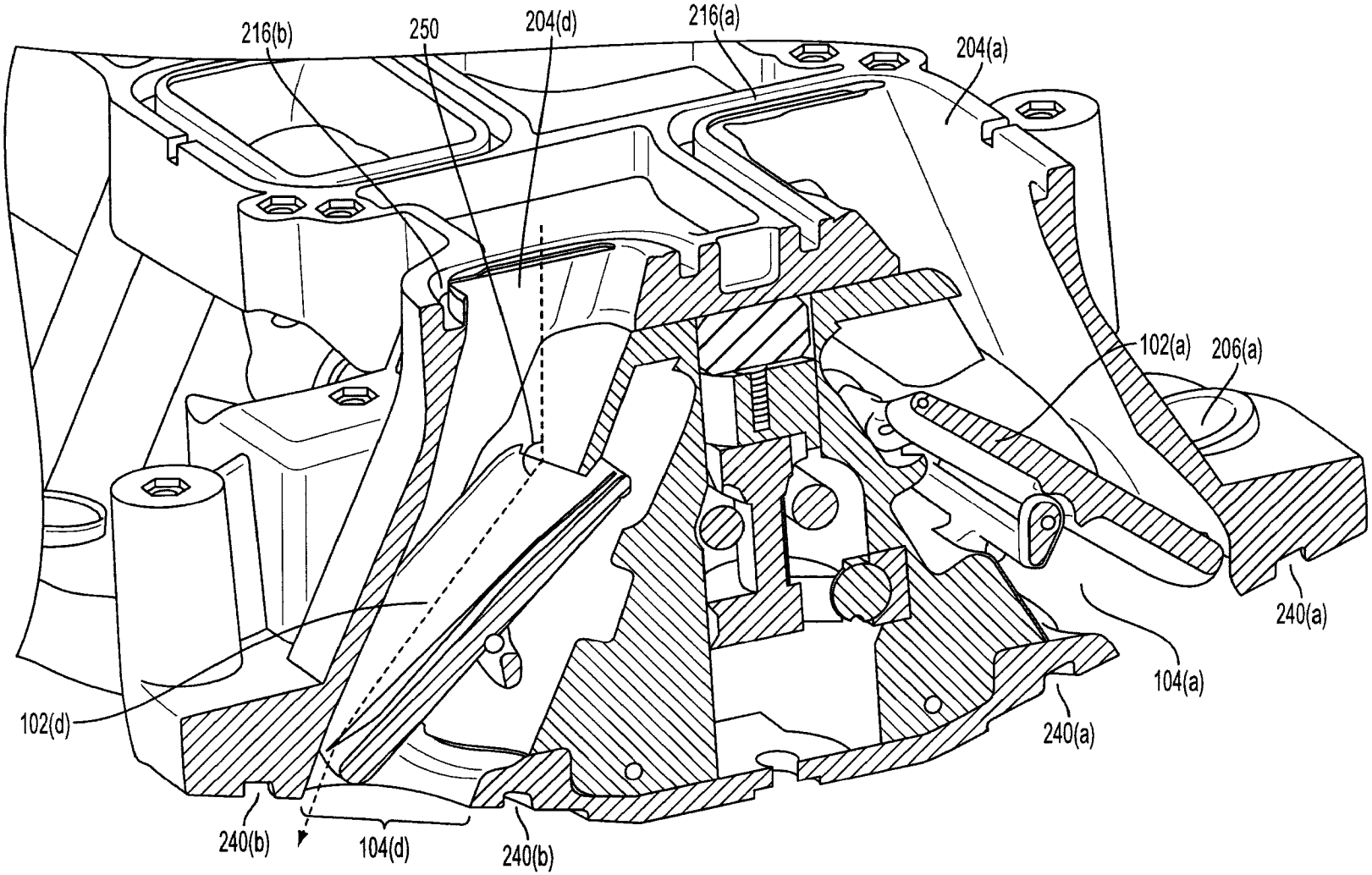

FIGS. 6A and 6B illustrate cross-sectional perspective views of the inner frame assembly 100 installed into the lower manifold 200 when the flapper valves are in a retracted position (FIG. 6A) and, alternatively, in an engaged position (FIG. 6B). It should be appreciated that many of the actuating components discussed above are not shown in detail in FIGS. 6A and 6B and will not be described again with respect to these figures.

FIGS. 6A and 6B are provided to illustrate the positioning of the flapper valves within the respective intake runners. First, as shown in FIG. 6A, flapper valves 102(*a*) and 102(*d*) are shown in a retracted position such that intake runners 104(*a*) and 104(*d*) are provided with a substantially uniform cross sectional area. Accordingly, as air enters the intake ports 204(*a*) and 204(*d*) and travels downward through intake runners 104(*a*) and 104(*d*), the air travels at a substantially equal rate/velocity at the point it enters intake ports 204(*a*) and 204(*d*) to the point where it exits the intake runners into the combustion chambers. The air flow path is illustrated, for example, by a dashed line in intake runner 104(*d*). As further shown, duct 206(*a*) is position on intake lower manifold 200 adjacent to intake runner 104(*a*). Although not shown in FIGS. 6A and 6B, fuel injectors are affixed into each of the six ducts as discussed above. As is well known to those skilled in the art, during the intake stroke of the engine combustion cycle, fuel is injected into the combustion chambers and mixed with the air that is exiting the intake runners at the head mounting surface. It is noted that only duct 206(*a*) is shown in this perspective drawing although it should be appreciated that a duct for a fuel injector is also provided adjacent to intake runner 104(*d*).

As further shown in FIG. 6B, flapper valves 102(*a*) and 102(*d*) are shown in the engaged position. As discussed in detail above, the hypoid gear-set is provided to actuate the flapper valves 102(*a*) and 102(*d*) into an extended position using a four-bar link mechanism design. By extending the flapper valves 102(*a*) and 102(*d*) into the intake runners 104 (*a*) and 104(*d*), the cross-sectional area of the intake runners is effectively reduced. As a result, the intake air velocity is increased, effectively creating additional tumble and swirl to the charge motion within the combustion chamber. The air flow path is illustrated, for example, by a dashed line in intake runner 104(*d*) and the approach angle approximately 25° . in the exemplary embodiment, although it is reiterated that the disclosure should in no way be limited to this dimension. FIG. 6B illustrates the approach angle 250 (i.e., angle 250 is shown as 155° -180 minus 25°). Additionally, it should be appreciated that by positioning the tips of the flapper valves in close proximity to the tips of the fuel injectors, the intake air is at its highest velocity at the point of air-fuel mixture. Also, as would be understood by one of skill in the art, the curvature and shape of the flapper valves can be adjusted to vary the swirl as warranted by the intake manifold design.

Finally, as shown in FIGS. 6A and 6B, continuous seal grooves are provided that extend around the outer circumference of each of the intake ports (e.g., 216(*a*) and 216(*b*)) and the intake runners (e.g., 240(*a*) and 240(*b*)) and are provided to seal them to the adjacent component to the lower intake manifold 200. In the exemplary embodiment, continuous O-ring seals are positioned within the seal grooves 216(*a*), 216(*b*), 240(*a*) and 240(*b*). By using continuous seal groove surfaces (e.g., continuous O-ring seals) rather than split seal groove surfaces, air leakage is prevented or minimized during engine operation. Moreover, by implementing the four-bar link mechanism design to actuate the flapper valves, the tips of each flapper valve remain above the seal grooves 240(*a*) and 240(*b*) in the retracted position (as shown in FIG. 6B) and substantially adjacent to the tips of the fuel injectors in the engaged position (as shown in FIG. 6A). It is reiterated that by extending the tips of the flapper valves to be substantially adjacent to the tips of the fuel injectors, there is minimal drop in air velocity that otherwise occurs as the flapper valve tips are farther away from the fuel injector tips as would be understood by one of skill in the art.

What is claimed is:

1. An intake control system for a multi-cylinder internal combustion engine, comprising:

a manifold having a plurality intake ports; and an inner frame assembly configured to be inserted into the manifold, the inner frame assembly having:

a main body with a first plurality of recessions on a first lateral side of the inner frame and a second plurality of recessions on a second lateral side of the inner frame opposite the first lateral side, a first plurality of flapper valves that are each positioned within the first plurality of recessions, respectively, and a second plurality of flapper valves that are each positioned within the second plurality of recessions, respectively, wherein each of the flapper valves is pivotally coupled to the inner frame assembly by upper and lower mechanical links, a first horizontal shaft coupled to at least one upper mechanical link that is coupled to a respective one of the first plurality of flapper valves and to at least one upper mechanical link that is coupled to a respective one of the second plurality of flapper valves, and a second horizontal shaft coupled to at least one upper mechanical link that is coupled to a respective one of the first plurality of flapper valves and to at least one upper mechanical link that is coupled to a respective one of the second plurality of flapper valves, wherein, when the inner frame assembly is inserted into the manifold, the plurality of recessions of the inner frame and the manifold together form a plurality of intake runners that correspond to the plurality of intake ports of the manifold.

2. The intake control system of claim 1, wherein the first horizontal shaft is configured to rotate in a first direction to drive the flapper valves coupled thereto to an extended position within the respective intake runners, and wherein the second horizontal shaft is configured to rotate in a second direction, opposite the first direction, to drive the flapper valves coupled thereto to an extended position within the respective intake runners.

3. The intake control system of claim 2, wherein the inner frame assembly further comprises a hypoid gear-set configured to rotate the first and the second horizontal shafts.

4. The intake control system of claim 3, wherein the inner frame assembly further comprises a spring-loaded wedge block positioned above the hypoid gear-set.

5. The intake control system of claim 3, wherein inner frame assembly further comprises a worm-drive gear-set actuated by a DC electric motor that is configured to drive the hypoid gear-set.

6. The intake control system of claim 5, wherein the inner frame assembly further comprises a spring-loaded wedge block positioned adjacent to the worm-drive gear-set.

7. The intake control system of claim 1, wherein a four-bar link mechanism is defined by the at least one upper mechanical link, the at least one lower mechanical link, a corresponding flapper valve and the main body of the inner frame assembly.

8. The intake control system of claim 1, wherein the manifold further comprises a plurality of fuel injection ducts adjacent to the plurality of intake runners, respectively, and each fuel injection duct is configured to receive a fuel injector.

9. The intake control system of claim 8, wherein the plurality of flapper valves are configured to extend into the respective intake runners such that the tip of each flapper valve is substantially adjacent to a tip of a corresponding fuel injector.

10. The intake control system of claim 1, wherein the inner frame assembly further comprises a spur gear-set coupled to an encoder configured to determine the position of the plurality of flapper valves within the plurality of intake runners, respectively.

11. The intake control system of claim 10, wherein the spur gear-set has a 4:1 gear ratio.

12. The intake control system of claim 1, wherein the plurality of flapper valves are configured to extend into the respective intake runners.

13. The intake control system of claim 12, wherein the air flow path in each of the plurality of intake runners has an approach angle of 25° or less when the plurality of flapper valves are in a fully extended position.

14. The intake control system of claim 1, wherein the manifold further comprises a plurality of continuous seals on the outer circumference of the plurality of intake ports, respectively.

15. The intake control system of claim 1, wherein the multi-cylinder internal combustion engine is a V-type combustion engine.

16. An inner frame assembly for an intake manifold of a multi-cylinder internal combustion engine, comprising:

a main body having a first plurality of recessions on a first lateral side of the inner frame and a second plurality of recessions on a second lateral side of the inner frame opposite the first lateral side;

a first plurality of flapper valves that are each positioned within the first plurality of recessions, respectively, and a second plurality of flapper valves that are each positioned within the second plurality of recessions, respectively;

a first horizontal shaft having a plurality of first upper mechanical links respectively coupled to at least one of the first plurality of flapper valves and to at least one of the second plurality of flapper valves;

a second horizontal shaft having a plurality of second upper mechanical links respectively coupled to at least one of the second plurality of flapper valves and to at least one of the first plurality of flapper valves; and a plurality of lower mechanical links, each coupling a respective flapper valve to the main body.

17. The inner frame assembly of claim 16, wherein a four-bar link mechanism is defined by an upper mechanical link, a lower mechanical link, a corresponding flapper valve and the main body.

18. The inner frame assembly of claim 16, further comprising a hypoid gear-set configured to drive the first and the second actuating members.

19. The inner frame assembly of claim 18, further comprising a worm-drive gear-set actuated by a DC electric motor and configured to drive the hypoid gear-set.

20. The inner frame assembly of claim 18, wherein the DC electric motor actuates a worm gear driver of the worm-drive gear-set, which drives the hypoid gear-set causing the first and the second actuating members rotates such that the plurality of flapper valves are extended in an outward direction.

21. The inner frame assembly of claim 16, wherein the multi-cylinder internal combustion engine is a V-type combustion engine.

* * * * *